US006877951B1

(12) United States Patent
Awdalla

(10) Patent No.: US 6,877,951 B1
(45) Date of Patent: Apr. 12, 2005

(54) ROTARY RAM-IN COMPRESSOR

(76) Inventor: Essam T. Awdalla, 2309 Myron Dr. Apt. F, Raleigh, NC (US) 27607

( * ) Notice: Subject to any disclaimer, the term of this patent is extended or adjusted under 35 U.S.C. 154(b) by 35 days.

(21) Appl. No.: 10/669,514

(22) Filed: Sep. 23, 2003

(51) Int. Cl.[7] ..... F01D 1/06
(52) U.S. Cl. ..... 415/120; 416/186 R
(58) Field of Search ..... 415/120, 62, 68, 415/69, 202; 416/185, 186 R, 223 A, 223 B

(56) References Cited

U.S. PATENT DOCUMENTS

| | | | | | |
|---|---|---|---|---|---|
| 4,227,868 | A | * | 10/1980 | Nishikawa et al. | 416/186 R |
| 4,278,399 | A | * | 7/1981 | Erickson | 415/199.1 |
| 4,358,244 | A | * | 11/1982 | Nishikawa et al. | 416/186 R |
| 6,739,835 | B2 | * | 5/2004 | Kim | 416/186 R |

FOREIGN PATENT DOCUMENTS

| | | | | | |
|---|---|---|---|---|---|
| DE | 3243169 | A1 | * | 5/1984 | F16H/47/06 |
| JP | 54013002 | A | * | 1/1979 | F04D/29/30 |
| JP | 55087894 | A | * | 7/1980 | F04D/29/28 |
| WO | PCT/US00/17044 | | | 1/2001 | |

* cited by examiner

*Primary Examiner*—Edward K. Look
*Assistant Examiner*—Igor Kershteyn
(74) *Attorney, Agent, or Firm*—Glasgow Law Firm, PLLC

(57) ABSTRACT

A rotary ram-in compressor for use in gas turbine engines and the like, having a plurality of vanes attached to discs, with the opposing parts of each two adjacent vanes defining a feeding channel in-between. In operation, working gases are rammed through the feeding channels, followed by positive displacement of the rammed-in gases to a receiver wherein pressurized gases collect. The pressurized gases are actively swept from the receiver by either a successive rotary ram-in compressor or a successive rotary ram compressor.

6 Claims, 5 Drawing Sheets

ROTARY RAM-IN COMPRESSOR

FIELD OF THE INVENTION

The present invention relates to a positive displacement compressor and, more particularly, to a rotary positive displacement compressor convenient for use in gas turbine engines and the like.

DESCRIPTION OF PRIOR ART

Rotary compressors are well known devices, used in several fields to develop a pressure gradient between two points across a stream of working gases. Two main types of rotary compressors are in use, dynamic compressors, i.e., centrifugal flowing, axial flowing, and the combined types, and positive displacement compressors. In dynamic compressors the working gases are accelerated followed by its deceleration within diverging passages, wherein part of its kinetic energy is converted into static pressure rise. In positive displacement compressors the pressure is increased by reducing the specific volume of the gases during their passage through the compressor.

Dynamic Compressors are widely in use in gas turbine and steam engines as they are able to raise the pressure of a relatively large volume of working gases while operating at relatively high rotational speeds. On the contrary, conventional types of positive displacement compressors are not convenient for use in gas turbine engines, and the like, as the friction between the rubbing parts within them limits their practically useful range of operating rotational speeds.

SUMMARY OF THE INVENTION

The present invention provides a rotary positive displacement compressor having no rubbing parts within, which allows its use in the applications wherein relatively high operating rotational speeds are needed.

Accordingly, the present invention provides a rotary ram-in compressor having a plurality of feeding channels, moving at high speed, through which working gases are rammed, followed by positive displacement of the rammed in gases to a receiver. In a preferred embodiment, the rotary ram-in compressor comprises a stationary casing having at least one inlet passage, for admission of working gases, and a receiver; a drive shaft supported for rotation in a given direction inside the casing by an arrangement of bearings; and a rotor assembly comprising a first disk secured for rotation with the drive shaft and lying in a first plane transverse to the rotational axis of the drive shaft; a second disk lying in a second plane transverse to the rotational axis of the drive shaft, with the inner surfaces of the two disks defining an annular space in-between; and a plurality of vanes arranged circumferentially within said annular space, each vane attached to both disks defining the annular space, each vane has a leading edge, a trailing edge, a concave surface and a convex surface, with the average angles of inclination of the successive portions of the vane with respect to a plane comprising the midpoint of the vane and perpendicular to a radial plane including the rotational axis of the rotor and the midpoint of the vane decreases preferably gradually from its leading edge towards its trailing edge, within a range from about +2 to about−18 degrees, the opposing parts of the surfaces of each two adjacent vanes along with the opposing parts of the two disks' surfaces confined between the opposing parts of the surfaces of each two adjacent vanes defining a feeding channel between them, each feeding channel has an inlet communicating with the inlet passage of the compressor, and an outlet communicating with the relatively inner part of the annular space confined by the vanes, with means for active sweeping of the pressurized gases from the compressor's receiver being provided.

Unlike the rotary ram compressor disclosed in the inventor's earlier International Patent Application Number PCT/US00/17044, entitled "Rotary ram fluid pressurizing machine", no deceleration of the rammed-in gases occurs within the channels of the rotary ram-in compressor of the present invention. In a preferred embodiment of the rotary ram-in compressor of the present invention, each two opposing surfaces, of those defining each of the feeding channels between them, are parallel to one another, with the cross-sectional area of the inlet of each of the channels being equal to the cross sectional area of its outlet. In another preferred embodiment, in order to increase the level of pressure rise provided by the rotary ram-in compressor of the present invention, each of the feeding channels is slightly converging from its inlet towards its outlet. The convergence of the feeding channel is provided by designing the boundaries confining the channel between them so that the axial width of the channel and/or the width between the opposing parts of the surfaces of the two adjacent vanes confining the channel between them decrease preferably gradually from the inlet of the channel towards its outlet, and hence, the cross-sectional area of the channel decreases preferably gradually from its inlet towards its outlet.

The gradual decrease in the axial width of the feeding channel is provided by designing the part(s) of the surface(s) of one (or both) of the disks related to the channel and confined between the opposing parts of the surfaces of the two adjacent vanes so that it is sloping preferably gradually from the inlet of the channel towards its outlet. The gradual decrease in the width between the opposing parts of the surfaces of the two adjacent vanes is provided by designing the vanes with suitable angles of inclination at their different parts, according to the desired rate of convergence of the channel.

In operation, gases are rammed through the feeding channels of the compressor, which direct it to the relatively inner part of the annular space confined by the vanes. The rammed in gases are first compressed by both the pressurized gases collecting within the compressor's receiver and by the reaction force developed on the free parts of the concave surfaces of the vanes next to the outlets of the feeding channels, then, the pressurized freshly introduced gases are displaced in a generally radial inward direction to the receiver, by the relatively inner free parts of the concave surfaces of the vanes. As used herein, the free part of the concave surface of a vane refers to the part of the concave surface of the vane that is not opposed by any part of the surfaces of its adjacent vanes.

In a preferred embodiment, a rotary ram compressor is used for active sweeping of gases from the compressor's receiver, as the static pressure rise developed within its diverging channels prevents excess flow of pressurized gases from the receiver through its channels, regardless of the pressure level developed within the receiver, with the density and the pressure level of the gases within the receiver being dependant on the ratio between the volumetric rate with which gases are fed to the receiver by the compressor (which depends on the number of its feeding channels, and their dimensions and velocity) and the volumetric rate with which gases are swept from the receiver by the rotary ram compressor (which depends on the number of its channels, the dimensions of its channels' inlets, and their velocity).

In another preferred embodiment, a successive rotary ram-in compressor is used for active sweeping of gases from the compressor's receiver, as the static pressure rise developed within the receiver of the second rotary ram-in compressor prevents excess flow of gases from the receiver of the first rotary ram-in compressor through the feeding channels of the second rotary ram-in compressor, with the density and the pressure level of the gases within the receiver of the first rotary ram-in compressor being dependant on the ratio between the volumetric rate with which gases are fed to the receiver and the volumetric rate with which gases are swept from it.

If the volumetric rate with which gases are fed to the compressor's receiver equals the volumetric rate with which it is being swept from it, no pressure rise occurs within the receiver, with the pressure inside it being equivalent to that of the gases at the compressor's inlet. If the volumetric rate with which gases are fed to the receiver is greater than its sweeping volumetric rate, the density of gases within the receiver, and hence its pressure, will gradually increase till an equilibrium point is reached, at which the mass flow rates of gas feeding and gas sweeping from the receiver are equal to one another.

The maximum allowable pressure level of the gases within the receiver, at a given operating rotational speed, depends on the velocity with which the feeding channels moves, which should exceed the velocity of the back flow of the pressurized gases from the receiver to the feeding channels, due to the pressure gradient between them.

The velocity of the feeding channels of the ram-in compressor is kept below the speed of sound, to avoid the formation of shock waves, which if formed will interfere with the free ingestion of gases by the feeding channels, and thus, the maximum allowable pressure level within the receiver will be around double that of the pressure of gases at the compressor's inlet (at which the speed of back flow of the pressurized gases from the receiver to the feeding channels will be almost equivalent to the speed of sound), with most of the provided pressure rise within the receiver being due to increased density of the working gases.

BRIEF DESCRIPTION OF THE DRAWINGS

The description of the objects, features and advantages of the present invention, will be more fully appreciated by reference to the following detailed description of the exemplary embodiments in accordance with the accompanying drawings, wherein.

DETAILED DESCRIPTION

Figure 1:
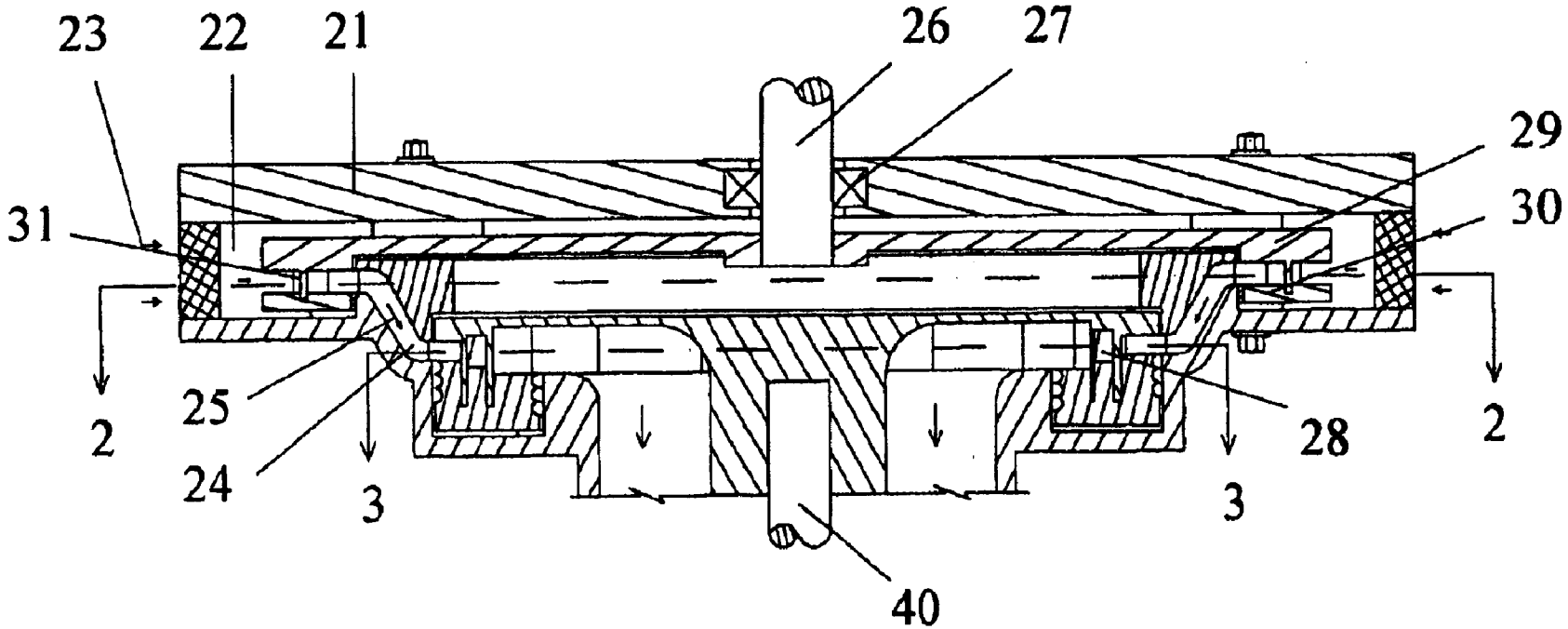
FIG. 1 is a sectional view in a schematic representation of an exemplary embodiment of a rotary ram-in compressor, in accordance with the present invention.

FIG. 1 is a sectional view in a schematic representation of an exemplary embodiment of a rotary ram-in compressor, in accordance with the present invention.

Figure 2:
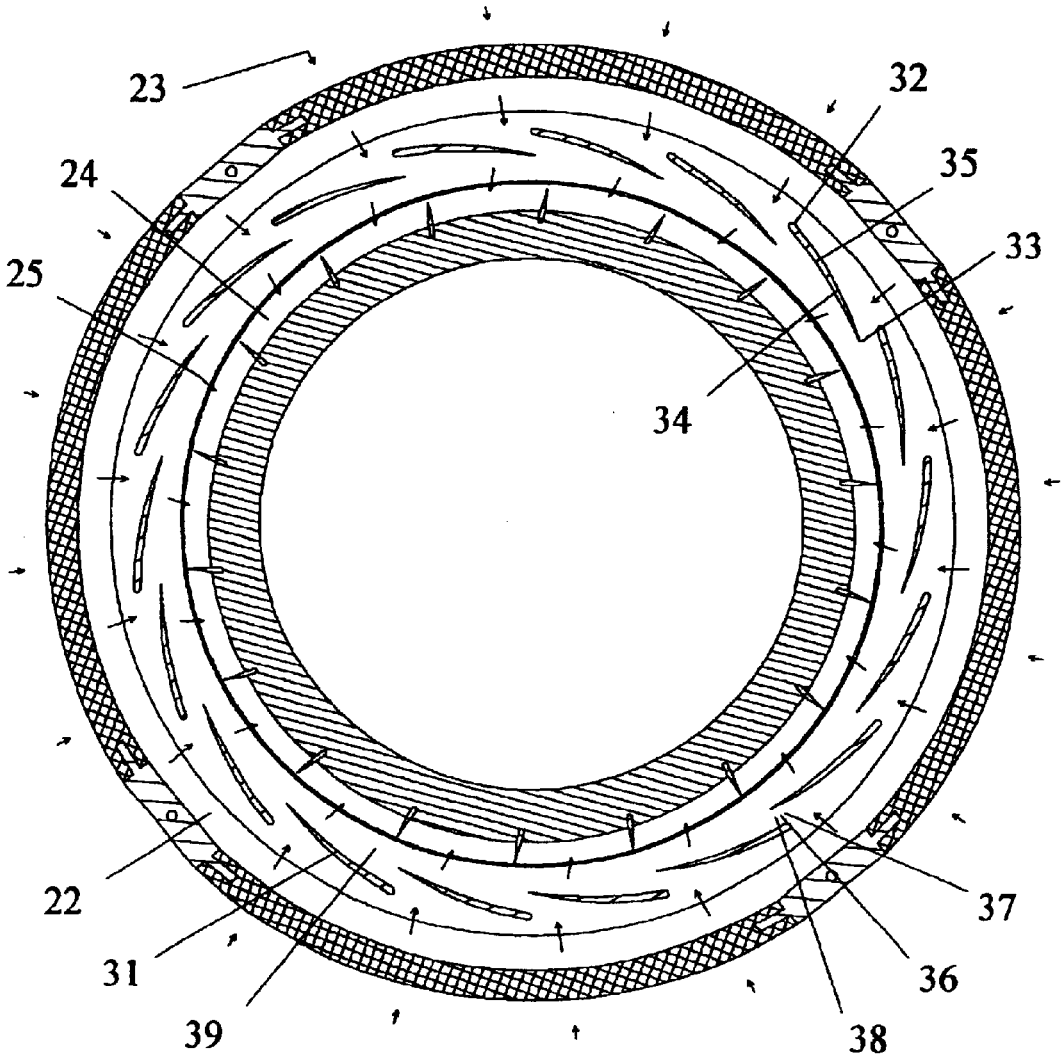
FIG. 2 is a cross sectional view, taken at the plane of line 2—2 in FIG. 1.

The main components of the rotary ram-in compressor in this embodiment are a stationary casing (21) having an inlet passage (22) for admission of working gases (23), and a receiver (24) wherein pressurized gases (25) collect; a drive shaft (26) supported for rotation in a given direction inside the casing by an arrangement of bearings (27), and extending to a drive receiving end located outside the casing; and a rotor assembly housed inside the casing and secured for rotation with the drive shaft (26). The rotor assembly comprises a first disk (29) secured for rotation with the drive shaft (26) and lying in a first plane transverse to the rotational axis of the drive shaft; a second disk (30) having a large open center and a widened rim, and lying in a second plane transverse to the rotational axis of the drive shaft, with the inner surfaces of the two disks defining an annular space in-between; and a plurality of vanes (31) arranged circumferentially within said annular space, each vane attached to both disks defining the annular space. As shown in FIG. 2 which is a cross sectional view, taken at the plane of line 2—2 in FIG. 1, each vane has a leading edge (32), a trailing edge (33), a concave surface (34) and a convex surface (35), with the average angles of inclination of the successive portions of the vane with respect to a plane comprising the midpoint of the vane and perpendicular to a radial plane including the rotational axis of the rotor and the midpoint of the vane decreases preferably gradually from its leading edge towards its trailing edge, within a range from about +2 to about−18 degrees, the opposing parts of the surfaces of each two adjacent vanes along with the opposing parts of the two disks' surfaces confined between the opposing parts of the surfaces of each two adjacent vanes defining a feeding channel (36) between them, each feeding channel (36) having an inlet (37) communicating with the inlet passage of the compressor (22), and an outlet (38) communicating with the relatively inner part of the annular space confined by the vanes (39). The embodiment also includes a rotary ram compressor (28) for active sweeping of the pressurized gases (25) from the rotary ram-in compressor's receiver (24).

In operation, working gases (23) are rammed through the feeding channels (36) of the compressor, which direct it to the relatively inner part of the annular space confined by the vanes (39). The rammed in gases are first compressed by both the pressurized gases (25) collecting within the compressor's receiver (24) and the reaction force developed on the free parts of the concave surfaces of the vanes next to the outlets of the feeding channels (36), then, the pressurized freshly introduced gases are displaced in a generally radial inward direction to the receiver (24), by the relatively inner free parts of the concave surfaces of the vanes (34). The pressurized gases (25) are actively swept from the receiver (24) by the rotary ram compressor (28) which is driven by another driving shaft (40).

Figure 3:
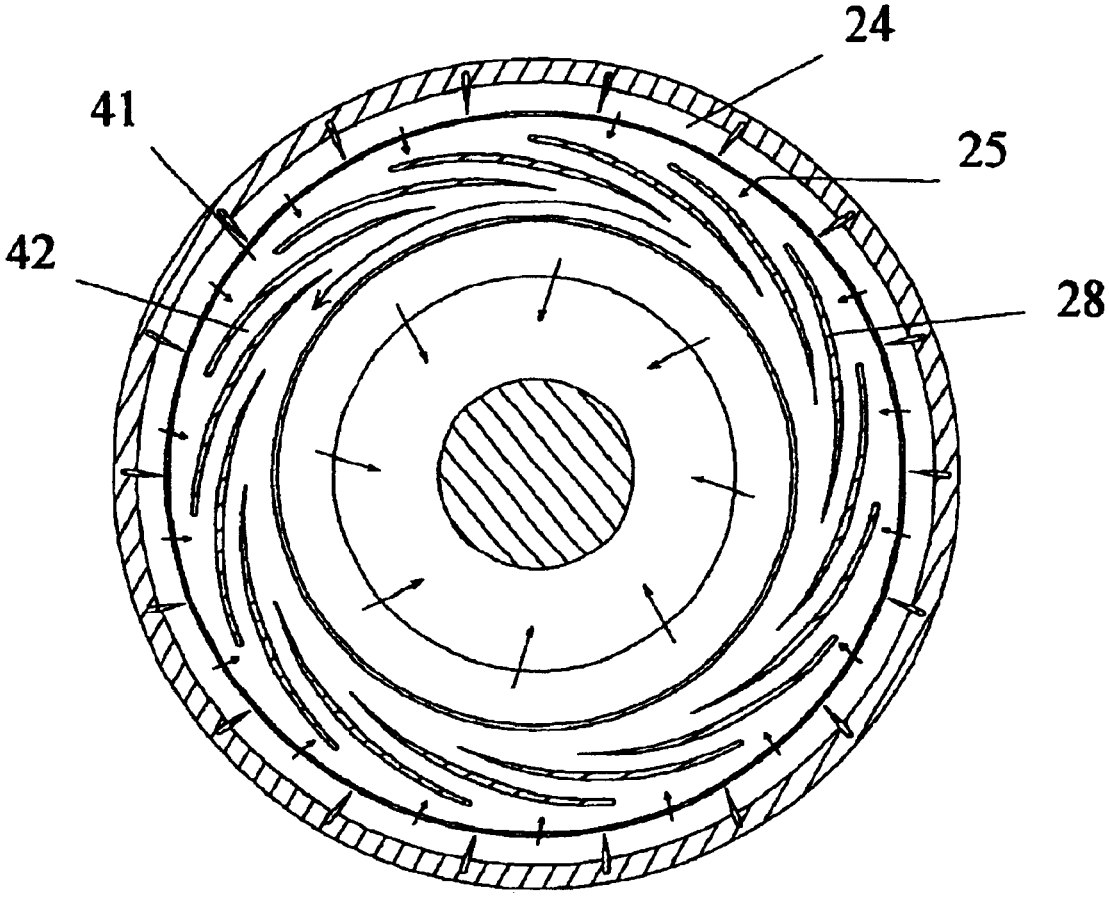
FIG. 3 is a cross sectional view, taken at the plane of line 3—3 in FIG. 1.

As also shown in FIG. 3 is a cross sectional view, taken at the plane of line 3—3 in FIG. 1, the compressor's receiver (24) forms the inlet passage (41) of the rotary ram compressor (28) used for active sweeping of the pressurized gases (25). The static pressure rise developed within the diverging channels (42) of the rotary ram compressor (28) prevents excess flow of gases from the receiver (24) through them, regardless of the pressure level developed within the receiver (24), with the density and the pressure level of the gases within the receiver (24) being dependant on the ratio between the volumetric rate with which gases are fed to the receiver (24) by the rotary ram-in compressor and the volumetric rate with which gases are swept from the receiver (24) by the rotary ram compressor (28). The maximum allowable pressure level within the receiver (24), at a given operating rotational speed, will depend on the velocity with which the feeding channels (36) of the ram-in compressor moves, which should exceed the velocity of the back flow of the pressurized gases (25) from the receiver (24) to the feeding channels (36), due to the pressure gradient between them.

Figure 4:
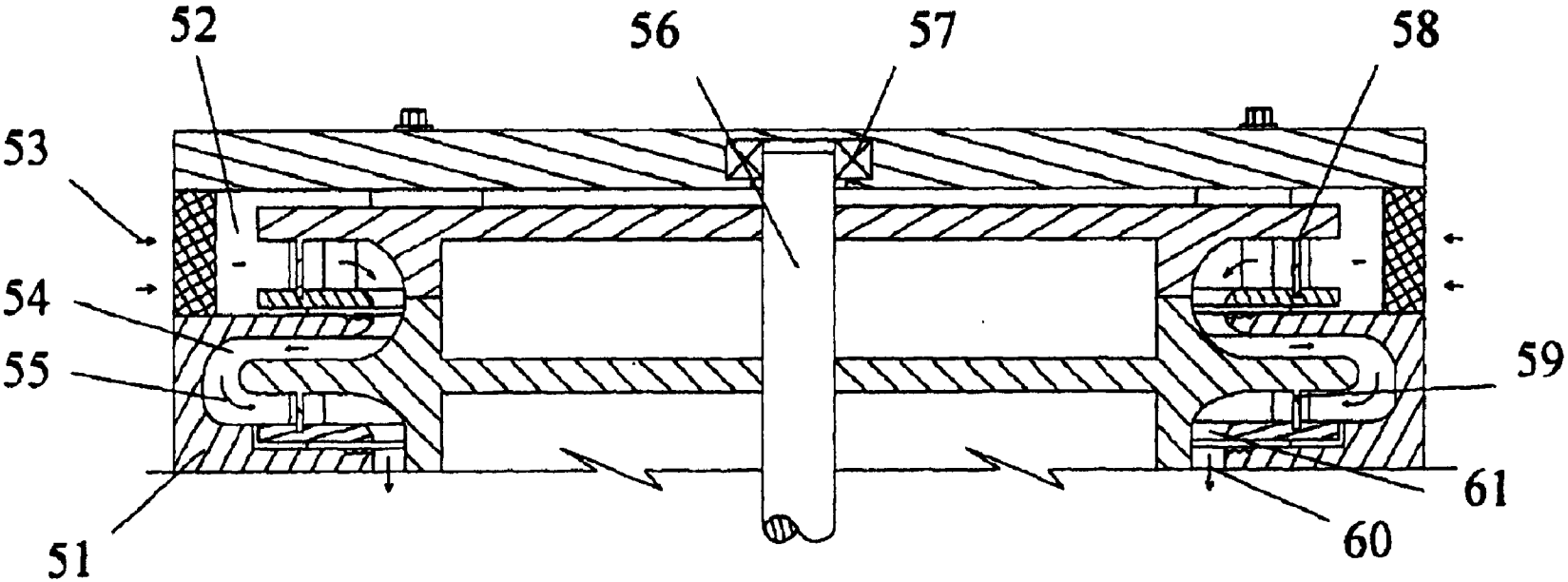
FIG. 4 is a sectional view in a schematic representation of another exemplary embodiment of a rotary ram-in compressor, in accordance with the present invention.

FIG. 4 is a sectional view in a schematic representation of another exemplary embodiment of a rotary ram-in compressor, in accordance with the present invention.

The main components of the rotary ram-in compressor in this embodiment are a stationary casing (51) having an inlet passage (52) for admission of working gases (53), and a receiver (54) wherein pressurized gases (55) collect; a drive shaft (56) supported for rotation in a given direction inside the casing by an arrangement of bearings (57), and extending to a drive receiving end located outside the casing; and a rotor assembly (58) housed inside the casing and secured for rotation with the drive shaft (56). The embodiment also includes a successive rotary ram-in compressor (59) for active sweeping of the pressurized gases (55) from the first ram-in compressor's receiver (54). The design of the rotor assemblies of the first and second rotary ram-in compressors in this embodiment are quite similar to those of the rotary ram-in compressor of the embodiment of FIGS. 1,2.

In operation, the pressurized gases (55) provided by the first rotary ram-in compressor (58) collect within its receiver (54), from which it is actively swept by the feeding channels of the second rotary ram-in compressor (59). The pressurized gases (60) provided by the second rotary ram-in compressor (59) collect within its receiver (61), from which it is actively swept by either a successive rotary ram-in compressor or a successive rotary ram compressor (not included in the drawing for simplicity).

The density and the pressure level of the gases (55) within the receiver (54) of the first rotary ram-in compressor depends on the ratio between the volumetric rate with which gases are fed to receiver (54) by the first rotary ram-in compressor (58) and the volumetric rate with which gases are swept from the receiver (54) by the second rotary ram-in compressor (59). As the first and second rotary ram-in compressors are driven by the same shaft (56), i.e. will have the same operating rotational speed, so, the ratio between their volumetric delivery and sweeping rates, and hence the pressure level of gases (55) within the receiver (54), will depend on the ratio between the total cross sectional area of the inlets of the feeding channels of the first rotary ram-in compressor (58) and the total cross sectional area of the inlets of the feeding channels of the second rotary ram-in compressor (59).

FIGS. 5–10 are schematic representations of alternatives in which the feeding channels confined between the opposing parts of the surfaces of the adjacent vanes of a rotary ram-in compressor in accordance with the present invention, may be designed.

As discussed herein before, the boundaries of each of the feeding channels are formed of the opposing parts of the surfaces of the two adjacent vanes confining the channel between them (right front and left rear surfaces of the drawings), and of the opposing parts of the disks' surfaces related to the channel and confined between the opposing parts of the surfaces of the two adjacent vanes.

Figure 5:
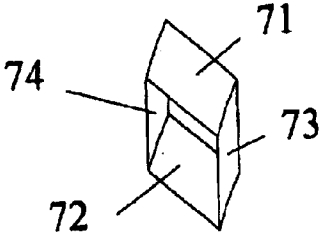

In FIG. 5 each two opposing surfaces (71,72 & 73,74), of those defining the feeding channel between them, are parallel to one another, with the cross-sectional area of the inlet of the channel being equal to the cross sectional area of its outlet.

Figure 6:
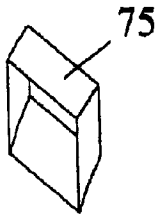

In FIG. 6 the feeding channel is slightly converging from its inlet towards its outlet. The convergence of the feeding channel is provided by designing the boundaries confining the channel between them so that the axial width of the channel decreases gradually from the inlet of the channel towards its outlet, with the gradual decrease in the axial width of the channel provided by designing one (75) of the opposing parts of the disks' surfaces related to the channel and confined between the opposing parts of the surfaces of the two adjacent vanes so that it is gradually sloping from the inlet of the channel towards its outlet.

Figure 7:
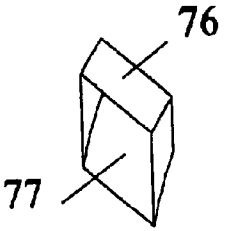
FIGS. 5–10 are schematic representations of alternative ways in which the feeding channels confined between the opposing parts of the surfaces of the adjacent vanes of a rotary ram-in compressor in accordance with the present invention, may be designed.

In FIG. 7 the feeding channel is slightly converging from its inlet towards its outlet. The convergence of the feeding channel is provided by designing the boundaries confining the channel between them so that the axial width of the channel decreases gradually from the inlet of the channel towards its outlet, with the gradual decrease in the axial width of the channel provided by designing both (76,77) of the opposing parts of the disks' surfaces related to the channel and confined between the opposing parts of the surfaces of the two adjacent vanes so that they are gradually sloping from the inlet of the channel towards its outlet.

Figure 8:
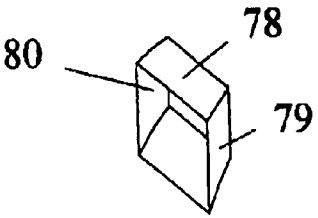

In FIG. 8 the feeding channel is slightly converging from its inlet towards its outlet. The convergence of the feeding channel is provided by designing the boundaries confining the channel between them so that the axial width of the channel and the width between the opposing parts of the surfaces of the two adjacent vanes (79,80) confining the channel between them decrease gradually from the inlet of the channel towards its outlet, with the gradual decrease in the axial width of the channel provided by designing one (78) of the opposing parts of the disks' surfaces related to the channel and confined between the opposing parts of the surfaces of the two adjacent vanes so that it is gradually sloping from the inlet of the channel towards its outlet, and with the gradual decrease in the width between the opposing parts of the surfaces of the two adjacent vanes (79,80) provided by designing the vanes with suitable angles of inclination at their different parts, according to the desired angle of convergence of the channel.

Figure 9:
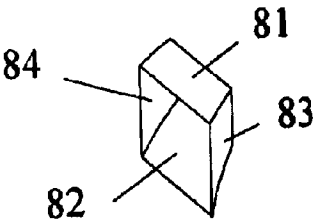

In FIG. 9 the feeding channel is slightly converging from its inlet towards its outlet. The convergence of the feeding channel is provided by designing the boundaries confining the channel between them so that the axial width of the channel and the width between the opposing parts of the surfaces of the two adjacent vanes (83,84) confining the channel between them decrease gradually from the inlet of the channel towards its outlet, with the gradual decrease in the axial width of the channel provided by designing both (81,82) of the opposing parts of the disks' surfaces related to the channel and confined between the opposing parts of the surfaces of the two adjacent vanes (83,84) so that they are gradually sloping from the inlet of the channel towards its outlet, and with the gradual decrease in the width between the opposing parts of the surfaces of the two adjacent vanes provided by designing the vanes with suitable angles of inclination at their different parts, according to the desired angle of convergence of the channel.

Figure 10:
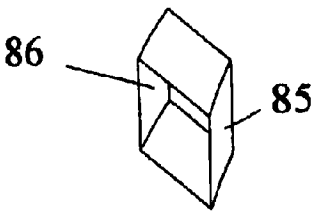

In FIG. 10 the feeding channel is slightly converging from its inlet towards its outlet. The convergence of the feeding channel is provided by designing the boundaries confining the channel between them so that the width between the opposing parts of the surfaces of the two adjacent vanes (85,86) confining the channel between them decreases gradually from the inlet of the channel towards its outlet, with the gradual decrease in the width between the opposing parts of the surfaces of the two adjacent vanes (85,86)

provided by designing the vanes with suitable angles of inclination at their different parts, according to the desired angle of convergence of the channel.

What is claimed is:

1. A rotary ram-in compressor comprising:

a stationary casing having at least one inlet passage for admission of working gases, and a receiver wherein pressurized gases collect;

a drive shaft supported for rotation in a given direction inside the casing by an arrangement of bearings; and a rotor assembly comprising a first disk secured for rotation with the drive shaft and lying in a first plane transverse to the rotational axis of the drive shaft; a second disk lying in a second plane transverse to the rotational axis of the drive shaft, with the inner surfaces of the two disks defining an annular space in-between; and a plurality of vanes arranged circumferentially within said annular space, each vane attached to both disks defining the annular space, each vane has a leading edge, a trailing edge, a concave surface and a convex surface, with the average angles of inclination of the successive portions of the vane with respect to a plane comprising the midpoint of the vane and perpendicular to a radial plane including the rotational axis of the rotor and the midpoint of the vane decreases preferably gradually from its leading edge towards its trailing edge, within a range from about +2 to about−18 degrees, the opposing parts of the surfaces of each two adjacent vanes along with the opposing parts of the two disks' surfaces confined between the opposing parts of the surfaces of each two adjacent vanes defining a feeding channel between them, each feeding channel has an inlet and an outlet, the cross sectional area of the inlet of each of the feeding channels being equal to the cross sectional area of its outlet, with means for active sweeping of the pressurized gases from the compressor's receiver being provided.

2. The rotary ram-in compressor of claim 1 wherein the means provided for active sweeping of the pressurized gases from the compressor's receiver comprises a successive rotary ram-in compressor.

3. The rotary ram-in compressor of claim 1 wherein the means provided for active sweeping of the pressurized gases from the compressor's receiver comprises a successive rotary ram compressor.

4. A rotary ram-in compressor comprising:

a stationary casing having at least one inlet passage for admission of working gases, and a receiver wherein pressurized gases collect;

a drive shaft supported for rotation in a given direction inside the casing by an arrangement of bearings; and and a rotor assembly comprising a first disk secured for rotation with the drive shaft and lying in a first plane transverse to the rotational axis of the drive shaft; a second disk lying in a second plane transverse to the rotational axis of the drive shaft, with the inner surfaces of the two disks defining an annular space in-between; and a plurality of vanes arranged circumferentially within said annular space, each vane attached to both disks defining the annular space, each vane has a leading edge, a trailing edge, a concave surface and a convex surface, with the average angles of inclination of the successive portions of the vane with respect to a plane comprising the midpoint of the vane and perpendicular to a radial plane including the rotational axis of the rotor and the midpoint of the vane decreases preferably gradually from its leading edge towards its trailing edge, within a range from about +2 to about−18 degrees, the opposing parts of the surfaces of each two adjacent vanes along with the opposing parts of the two disks' surfaces confined between the opposing parts of the surfaces of each two adjacent vanes defining a feeding channel between them, each feeding channel has an inlet and an outlet, each of the feeding channels converges from its inlet towards its outlet, with means for active sweeping of the pressurized gases from the compressor's receiver being provided.

5. The rotary ram-in compressor of claim 4 wherein the means provided for active sweeping of the pressurized gases from the compressor's receiver comprises a successive rotary ram-in compressor.

6. The rotary ram-in compressor of claim 4 wherein the means provided for active sweeping of the pressurized gases from the compressor's receiver comprises a successive rotary ram compressor.

* * * * *